US007258527B2

(12) United States Patent
Shih

(10) Patent No.: US 7,258,527 B2
(45) Date of Patent: Aug. 21, 2007

(54) VERTICAL AXIS WIND ENGINE

(76) Inventor: Chi-Kuang Shih, 11F.-2, No. 4, Lane 9, Liyuan 1st St., Linkou Township, Taipei County (TW)

( * ) Notice: Subject to any disclaimer, the term of this patent is extended or adjusted under 35 U.S.C. 154(b) by 199 days.

(21) Appl. No.: 11/022,875

(22) Filed: Dec. 28, 2004

(65) Prior Publication Data

US 2006/0140765 A1 Jun. 29, 2006

(51) Int. Cl.
*F03D 3/06* (2006.01)

(52) U.S. Cl. ..... 416/17; 416/41; 416/140; 415/4.2

(58) Field of Classification Search ..... 416/17, 416/41, 98, 117, 119, 132 B, 140, 142; 415/4.2, 415/26, 47; 290/44, 55
See application file for complete search history.

(56) References Cited

U.S. PATENT DOCUMENTS 4,406,584 A * 9/1983 Stepp ..... 416/41
4,494,007 A * 1/1985 Gaston ..... 416/119
4,496,283 A * 1/1985 Kodric ..... 416/119
6,779,966 B2 * 8/2004 Smith, II ..... 415/4.4

FOREIGN PATENT DOCUMENTS

FR 2668205 A1 * 4/1992
GB 2000233 A * 1/1979

* cited by examiner

*Primary Examiner*—Richard A. Edgar
(74) *Attorney, Agent, or Firm*—Bacon & Thomas, PLLC

(57) ABSTRACT

The present invention is to provide a vertical axis wind engine comprising at least one arm each having its center rotatably coupled to a vertical axis mounted on a base on the ground, each pair of the upper and lower arms adapted to define an airfoil receiving space for pivotably mounting an airfoil by pivot pins thereof; and at least one elastic stop member each provided on the arm proximate the airfoil and spaced from the pivot pins, each stop member adapted to limit a pivot angle of the airfoil and lift the pivot limitation for allowing the airfoil to pivot when the airfoil experiences a wind force larger than a maximum resistance force thereof, preventing the components of the wind engine from being damaged by strong wind or when the wind engine is operating in high speed.

5 Claims, 9 Drawing Sheets

VERTICAL AXIS WIND ENGINE

FIELD OF THE INVENTION

The present invention relates to vertical axis wind engines, and more particularly to such a vertical axis wind engine capable of preventing the arms, the airfoils, and other components of the wind engine from being damaged by strong wind or when the wind engine is operating in high speed.

BACKGROUND OF THE INVENTION

Conventionally, a wind engine is classified as a horizontal axis wind engine or a vertical axis wind engine based on the orientation of rotating axes of its vanes. For vanes of the vertical axis wind engine, they are pivotably mounted in a frame. The frame is fixedly coupled to a vertical axis. Its transmission is provided near the ground. To the contrary, in the horizontal axis wind engine each vane has its horizontal axis provided above the ground by a relatively long distance. Moreover, each of a plurality of vanes of a vertical axis wind engine can adapt itself to wind by providing a wide contour in a windward condition for fully taking advantage of the force of wind and thus for generating larger torque. To the contrary, each vane can adapt itself to wind by providing a narrow contour in a leeward condition for decreasing wind friction. As an end, wind's rotation on the vanes can be maximized for rotating the wind engine. As such, many power companies have spent much time and cost in research and development of commercial wind engines which almost all are vertical axis type wind engines due to above reason.

U.S. Pat. No. 226,357 to Saccone issued on Apr. 6, 1880 discloses an early vertical axis wind engine 10 as shown in FIG. 1. The vertical axis wind engine 10 comprises a plurality of vanes 11 of flat surface each pivotably mounted near a free end of one of a plurality of arms (five are shown) 12 of a star configuration. The arms 12 are adapted to rotate in response to wind blowing over surfaces of the vanes 11. Also, the vanes 11 orbit a central, vertical axis 13. Each vane 11 can adapt itself to wind by providing a wide contour in a windward condition for fully taking advantage of the force of wind. To the contrary, each vane 11 can adapt itself to wind by providing a narrow contour in a leeward condition for decreasing wind friction. However, factors such as air dynamics and construction of the vanes 11 were not taken into consideration in the patent. As such, an abrupt operation often occurs when the wind engine 10 rotates. That is, its operation is not smooth. Further, the vanes 11 tend to cause the wind engine 10 to rotate intermittently due to centrifugal force. As such, the rotating speed of the wind engine 10 may decrease greatly. And in turn, both the arms 12 and the vertical axis 13 rotate in a speed less than wind speed.

U.S. Pat. No. 2,038,467 to Zonoski issued on Apr. 21, 1936 discloses another vertical axis wind engine 20 as shown in FIG. 2. The vertical axis wind engine 20 comprises a plurality of flat vanes 21 coupled to a rotatable frame 22. Also, each vane 21 is pivotal about a pivotal axis 211 thereof and orbits a vertical axis 23 at a center of the frame 22. The wind engine 20 is excellent in a two-phase balance. Each vane 21 is adapted to pivot about 170 degrees from windward side (i.e., having a high rotation torque) to leeward side (i.e., having a low wind friction). Ideally, a draft phase is capable of rotating more than 180 degrees per revolution of the frame 22 of the wind engine 20. However, in fact the draft phase is only able to rotate an angle less than 180 degrees due to wind shadow and interference of vanes 21. As an end, the performance of the wind engine 20 is greatly lowered.

U.S. Pat. No. 4,383,801 to Pryor issued on May 17, 1983 discloses yet another vertical axis wind engine 30 as shown in FIG. 3. The vertical axis wind engine 30 comprises a plurality of airfoils 31 pivotably mounted in a rotatable frame 32. Each airfoil 31 is designed according to the principles of air dynamics such that the frame 32 is adapted to rotate in response to wind acting on the airfoils 31. An anemoscope 34 is formed in the frame 32 via a connection to the terminal end 33 of the center shaft. An angle-of-attack of each airfoil 31 is adapted to change in response to wind direction shown by the anemoscope 34. However, such vertical axis wind engine 30 is complicated in its mechanism. The angle-of-attack of each airfoil 31 can be adjusted to an optimum only when each airfoil 31 is disposed in either upwind or leeward. As to positions other than above (e.g., side wind condition), the performance is much lowered. It is thus often that the vertical axis wind engine 30 cannot start to operate automatically even in windy weather.

U.S. Pat. No. 6,688,842 to Boatner issued on Feb. 10, 2004 discloses a vertical axis wind engine 40 as shown in FIG. 4. The wind engine 40 comprises a rotor 42 including four upper arms and four lower arms, and four airfoils 41 each pivotably mounted between two corresponding upper and lower arms of the rotor 42 by means of a pivotal axis, each airfoil 41 adapted to change its angle-of-attack in response to the force of wind acting thereon. The airfoils 41 thus pivot to cause the rotor 42 to rotate about a vertical axis 43. Further, a drive shaft in the vertical axis 43 functions as means for coupling rotational movement from the rotor 42 to an electric power generator. It is noted that in the patent each airfoil 41 is limited to pivot an angle defined by first and second stop members 441 and 442. Such stop mechanism enables each airfoil 41 to align its orientation according to wind. Further, the airfoils 41 are adapted to orbit the vertical axis 43. By configuring as above, each airfoil 41 is able to combine lift and drag in low speed into lift only when the rotor 42 is rotating at a speed the same as or even higher than the speed of wind. As an end, the force of wind can be effectively utilized for converting into rotational movement of a useful device. Thus, continuing improvements of vertical axis wind engine are constantly being sought.

SUMMARY OF THE INVENTION

After considerable research and experimentation, a novel vertical axis wind engine according to the present invention has been devised so as to overcome the above drawbacks (e.g., low wind to rotation conversion efficiency, damage due to strong wind (e.g., hurricane), etc.) of the prior art.

It is an object of the present invention to provide a vertical axis wind engine comprising a vertical axis mounted on a base on the ground; a transmission provided in a lower portion of the vertical axis, the transmission having a drive shaft for coupling rotational movement from the vertical axis to an electric power generator; at least one arm each having its center rotatably coupled to the vertical axis wherein rotation of the arm causes the vertical axis to rotate the same, and wherein each pair of the upper and lower arms are adapted to define an airfoil receiving spaces therein; at least one airfoil each including two pivot pins provided at a top and a bottom thereof respectively, the pivot pins being distal the vertical axis, and each airfoil adapted to pivotably mount in the airfoil receiving space by pivoting about the pivot pins; and at least one elastic stop member each provided on the arm proximate the airfoil and spaced from the pivot pin, and each stop member adapted to limit a pivot angle of the airfoil, wherein each stop member is adapted to lift the pivot limitation of each airfoil for allowing the airfoil to pivot when the airfoil experiences a pushing force of the wind larger than a maximum resistance force thereof. Each of some airfoils is adapted to exhibit a wide contour for offering the most resistance to wind by pivoting the stop member to its limit when the airfoil is disposed at its windward side. Each of some other airfoils is adapted to exhibit a narrow contour for offering the least resistance to wind when it is disposed at its leeward side. By utilizing this, the force of wind acting on the airfoils can convert into torque for rotating the arms and thus the wind engine. Moreover, some airfoils may experience a pushing force of the wind larger than a maximum resistance force thereof in a strong wind condition (e.g., in hurricane). In response, the stop members pivot away from the arms due to the pushing of the airfoils. Thus, the pivot limitation of each airfoil is lifted for causing the airfoil to pivot so as to have a contour to offer the least resistance to wind. In such a manner, the force of wind exerted on the airfoils can be decreased greatly for preventing the arms, the airfoils, and other components of the wind engine from being damaged by strong wind or when the wind engine is operating in high speed.

It is another object of the present invention to further provide two opposite pivotal pawl elements at each pair of the arms, each pawl element being near a free end of the arm and distal the vertical axis. Each pawl element is adapted to pivot toward a predetermined direction only in response to force exerted thereon and is adapted to return to its original position after the force is removed such that the pawl elements are adapted to stop and prevent the airfoils from pivoting counterclockwise to its windward side from its leeward side and enable the airfoil to have a wide contour. Each airfoil is adapted to pivot clockwise to contact and pass the pawl elements after the pivot limitation imposed on the airfoil by the stop member has been lifted by strong wind so as to enable the airfoil to have a normal wide contour.

It is still another object of the present invention to provide a plurality of airfoils mounted in the airfoil receiving space such that size of each airfoil can be greatly decreased and the force of wind exerted on each airfoil can also be decreased. Such smaller airfoils are also easier to manufacture and are convenient, simple, and quick in its storage, shipment, and assembly.

It is yet another object of the present invention to provide a plurality of pairs of upper arm and lower arm radially extended from the vertical axis. Each pair of arms are adapted to define one of a plurality of airfoil receiving spaces therein. A set of a plurality of airfoils are pivotably mounted in the airfoil receiving space. Thus, a designer of vertical axis wind engine can flexibly customize the number of airfoils disposed between each pair of arms depending on applications wherein the plurality of pairs of upper arm and lower arm are radially extended from the vertical axis.

It is a further object of the present invention to provide at least one auxiliary airfoil longitudinally, pivotably mounted on a windward side of the airfoil proximate an outer end thereof between the pivot pins. The provision of the auxiliary airfoil aims at either exhibiting a wide contour of the airfoil by pivoting outwardly in the windward side of the airfoil so as to fully utilize the force of breeze or exhibiting a narrow contour of the airfoil by pivoting inwardly toward a surface of the airfoil for offering the least resistance to wind.

It is still further object of the present invention to provide an arm wherein its section as viewed from either a top or a bottom thereof toward the airfoil receiving space has a curved outer surface designed according to the principles of air dynamics for reducing wind resistance to a minimum when the force of wind acting on the rotatable arm and thus improving performance of the vertical axis wind engine.

It is yet further object of the present invention to provide a plurality of ropes each for interconnecting any two adjacent upper arms or any two adjacent lower arms with either end of the rope fastened at the free end of the arm proximate the pivot pin. The provision of the ropes aims at increasing a structural strength of the arms so as to withstand a strong wind and enable the wind engine to operate normally in high speed.

It is yet further object of the present invention to provide an upright weight at an outer end of each airfoil between the pivot pins. The provision of weight aims at shifting a center of gravity of the airfoil to a position substantially between the pivot pins for providing an increased stability to the pivoting airfoil.

The above and other objects, features and advantages of the present invention will become apparent from the following detailed description taken with the accompanying drawings.

DETAILED DESCRIPTION OF THE PREFERRED EMBODIMENTS

Figure 1:
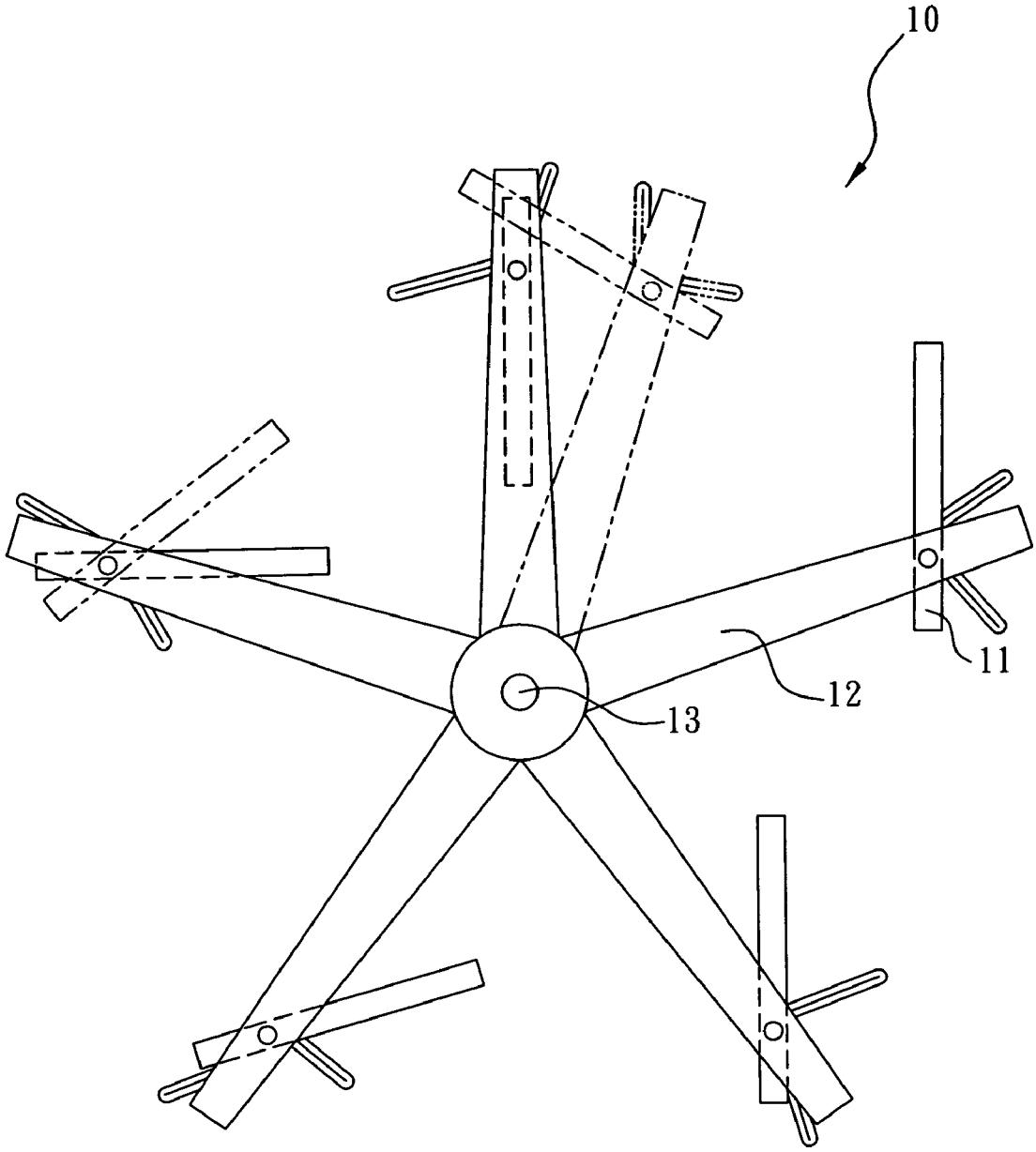
FIG. 1 (Prior Art)
FIG. 1 is a top plan view of a prior vertical axis wind engine according to U.S. Pat. No. 226,357.
Figure 2:
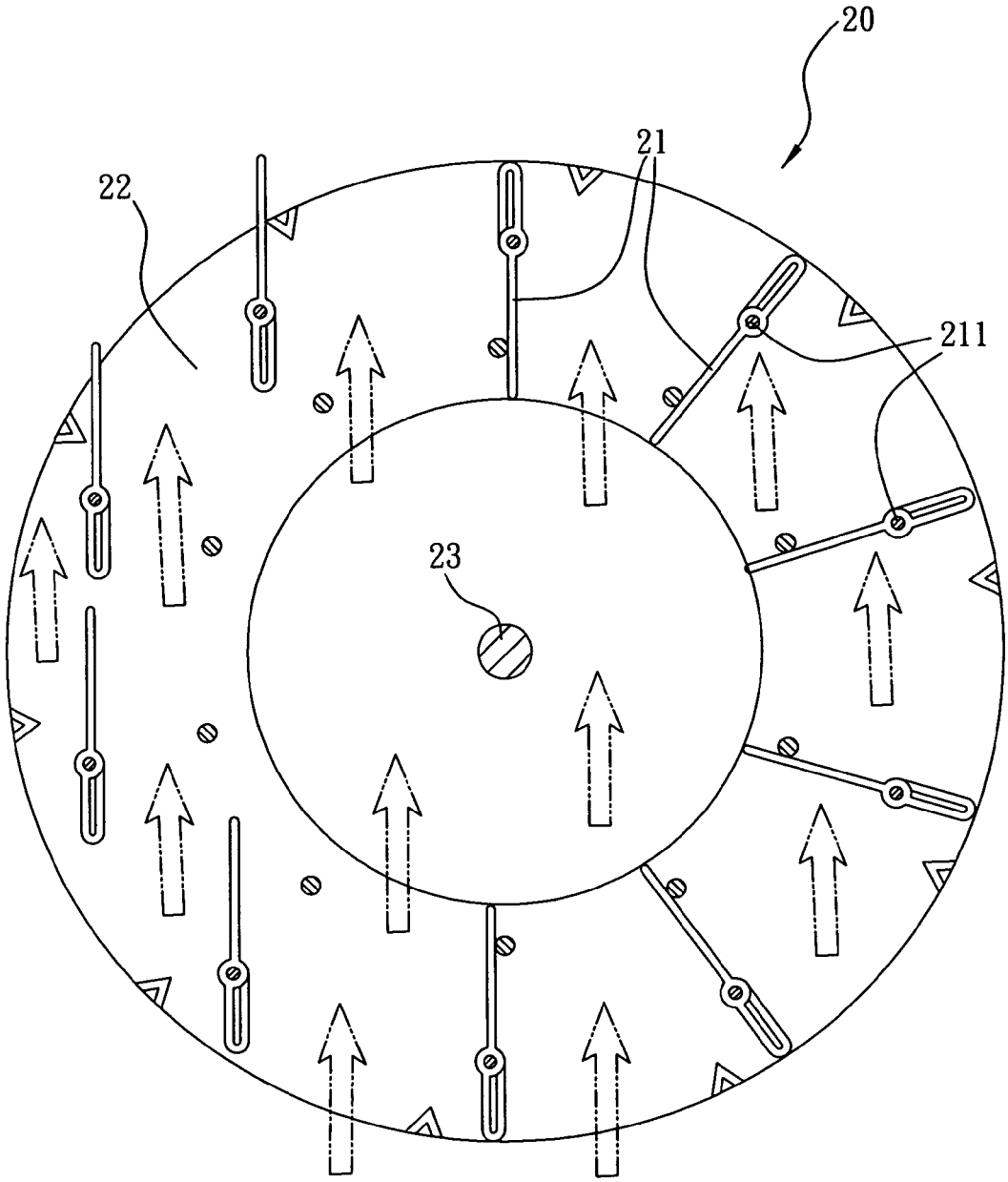
FIG. 2 (Prior Art)
FIG. 2 is a top plan view of a prior vertical axis wind engine according to U.S. Pat. No. 2,038,467.
Figure 3:
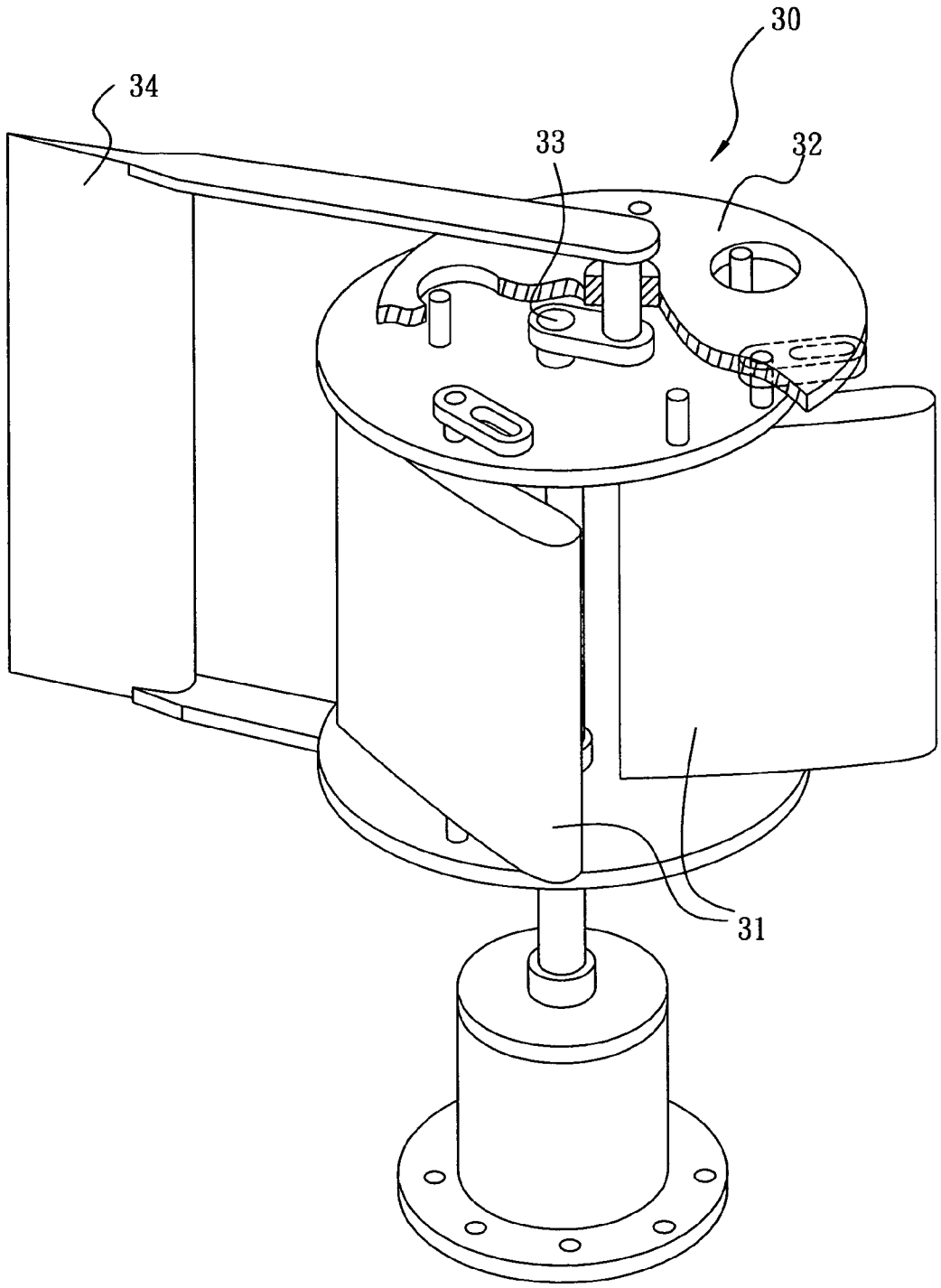
FIG. 3 (Prior Art)
FIG. 3 is a perspective view of a prior vertical axis wind engine according to U.S. Pat. No. 4,383,801.
Figure 4:
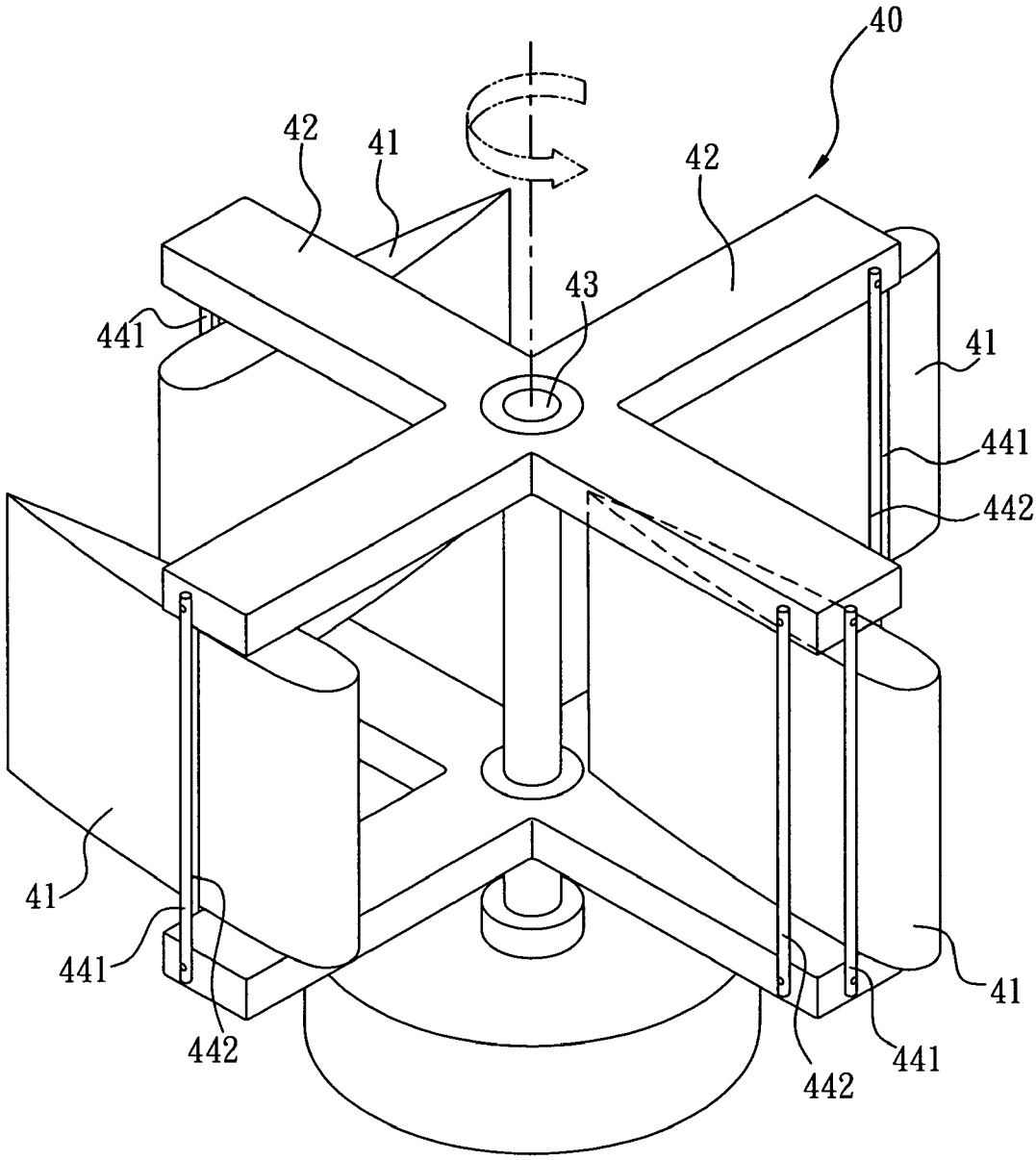
FIG. 4 (Prior Art)
FIG. 4 is a perspective view of a prior vertical axis wind engine according to U.S. Pat. No. 6,688,842.
Figure 5:
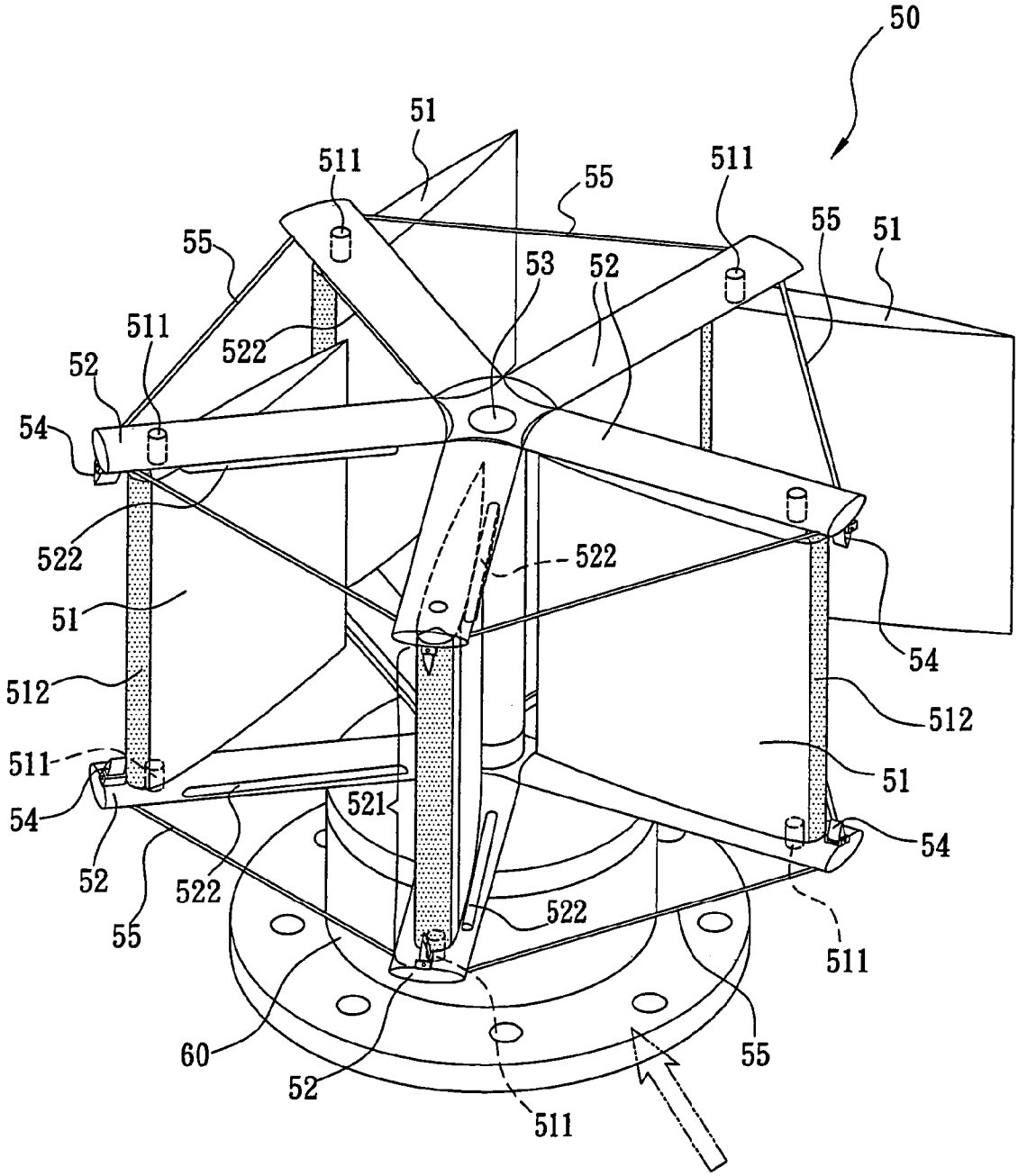
FIG. 5 is a perspective view of a first preferred embodiment of vertical axis wind engine according to the invention.

Referring to FIG. 5, there is shown a vertical axis wind engine 50 of a first preferred embodiment of the invention. The wind engine 50 comprises a central, vertical axis 53 mounted on a base on the ground, a transmission 60 provided in a lower portion of the vertical axis 53, and a drive shaft (not shown) in the transmission 60 for coupling rotational movement from the vertical axis 53 to an electric power generator (not shown). A frame comprises a plurality of arms 52 and another component as detailed later. The frame is rotatable about the vertical axis 53 (i.e., having its center rotatably coupled to the vertical axis 53). Rotation of the frame causes the vertical axis 53 to rotate the same. The frame comprises a plurality of (five are shown) upper arms 52, a plurality of (five are shown) lower arms 52, and a sleeve put on the vertical axis 53 for connecting the upper arms 52 to the lower arms 52 such that each pair of arms 52 (i.e., an upper arm 52 and a corresponding lower arm 52) are adapted to define one of a plurality of (five are shown) airfoil receiving spaces 521 therein. Each of a plurality of airfoils 51 is pivotably mounted in the airfoil receiving space 521. That is, the airfoil 51 is adapted to pivot in the airfoil receiving space 521. Each arm 52 either on top or bottom of the airfoil receiving space 521 has a flat or curved surface designed according to the principles of air dynamics. Preferably, the arm 52 having a curved surface similar to wing of an airplane for reducing wind resistance to a minimum when the force of wind acts on the rotatable arm 52.

In the embodiment, two pivot pins 511 are provided at top and bottom of the airfoil 51 respectively (i.e., opposite) and are proximate an outer side of the airfoil receiving space 521 distal the vertical axis 53. A pair of elastic stop members 522 are provided on each pair of arms 52 respectively. In detail, the stop members 522 are proximate top and bottom of each airfoil 51 respectively and are spaced from the pivot pins 511. Referring to FIG. 5, in the embodiment of the invention, the stop member 522 is provided on inner surface of each arm 52 and has a sufficient length to enable it to contact the surface of the airfoil 51 so as to limit a pivot angle of the airfoil 51.

Figure 6:
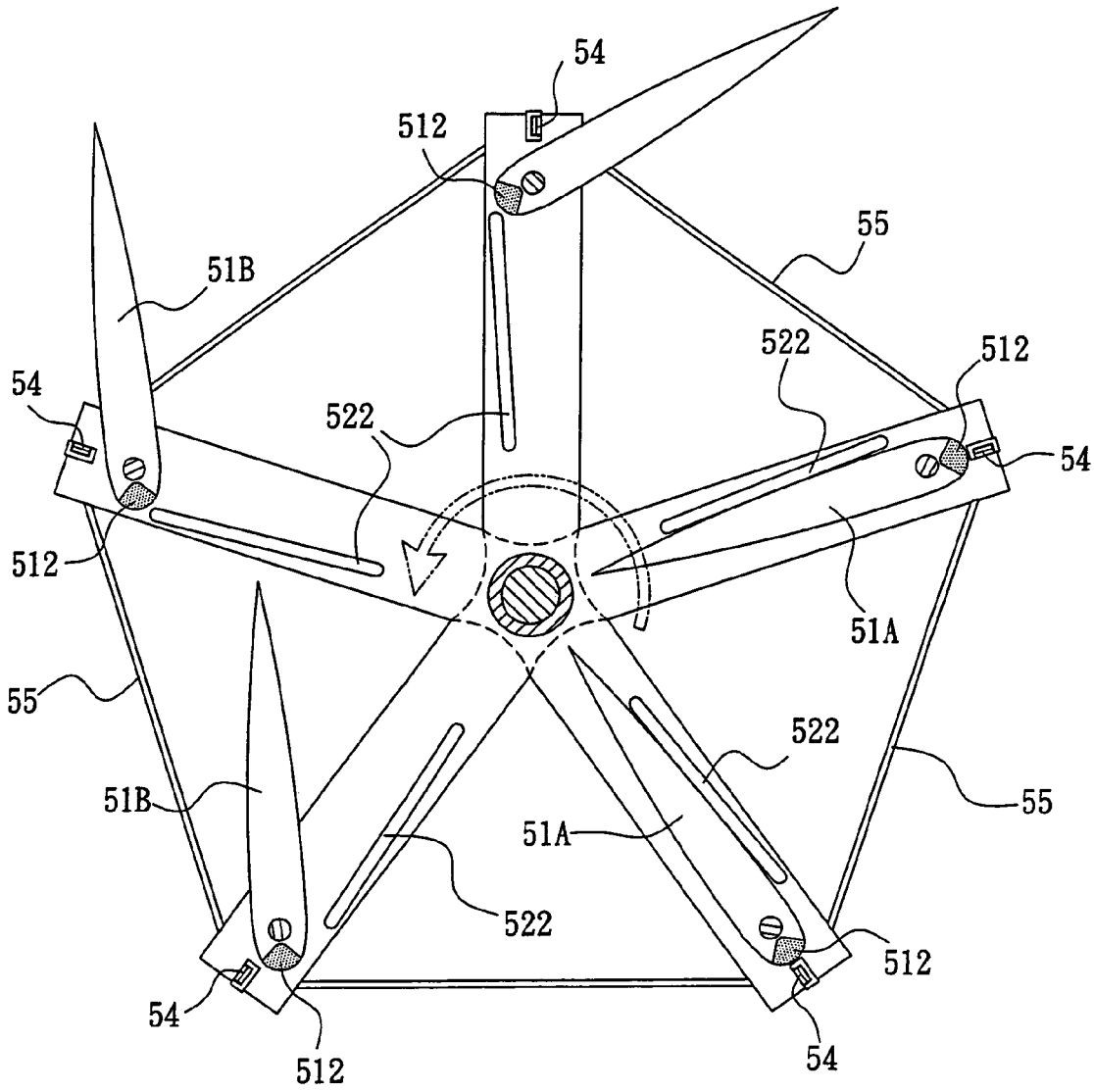
FIG. 6 is a top plan view of the wind engine of FIG. 5 where airfoils are oriented according to the wind.

Referring to FIG. 6, each of some airfoils 51A between the pair of arms 52 can exhibit a wide contour when a steady wind is blowing toward the vertical axis wind engine 50 (i.e., windward). As such, the most resistance to wind can be offered by these airfoils 51A. To the contrary, each of some other airfoils 51B in the pair of arms 52 can exhibit a narrow contour when they are disposed at a leeward side of the wind. As such, the least resistance to wind can be offered by these airfoils 51B. In such a manner, the force of wind exerted on the airfoils 51 can convert into torque for rotating the arms 52 and thus the vertical axis 53. Some airfoils 51 may experience a pushing force of the wind larger than a maximum resistance force thereof in a strong wind condition (e.g., in hurricane). In response, the stop members 522 pivot away from the arms 52 due to the pushing of the airfoils 51. As such, the pivot limitation of each airfoil 51 is lifted for causing each airfoil 51 to pivot so as to have a contour to offer the least resistance to wind. As a result, the force of wind exerted on the wind engine 50 can be decreased greatly for preventing the arms 52, the airfoils 51, and other components of the wind engine 50 from being damaged by strong wind or when the wind engine 50 is operating in high speed.

Note that the stop members 522 may be provided in a position different from above in implementing the invention. For example, the stop member 522 is provided on an outer surface of the airfoil 51 proximate the arm 52 and has a sufficient length to enable it to contact the surface of the arm 52 so as to limit a pivot angle of the airfoil 51. Likewise, some airfoils 51 may experience a pushing force of the wind larger than a maximum resistance force thereof in a strong wind condition. In response, the stop members 522 pivot onto the airfoil 51. As such, the pivot limitation of each airfoil 51 is lifted for causing each airfoil 51 to pivot so as to have a contour to offer the least resistance to wind. As a result, the force of wind exerted on the wind engine 50 can be decreased greatly for preventing the components of the wind engine 50 from being damaged by strong wind or when the wind engine 50 is operating in high speed.

Referring to FIGS. 5 and 6 again, in the embodiment two opposite pivotal pawl elements 54 are provided at inner surfaces of each pair of arms 52. Each pawl element 54 is near a free end of the arm 52 and is distal the vertical axis 53. The pawl element 54 is adapted to pivot toward a predetermined direction only in response to force exerted thereon and is adapted to return to its original position after the force is removed. The provision of the pawl elements 54 can stop the airfoils 51 and prevent the same from pivoting counterclockwise to its windward side from its leeward side. Otherwise, a wide contour of the airfoil 51 cannot be obtained. Moreover, each airfoil 51 is adapted to pivot clockwise to contact and pass the pawl elements 54 after a limitation imposed on the airfoil 51 by the stop members 522 has been lifted by strong wind. As an end, a normal, wide contour of the airfoil 51 can be obtained. Moreover, an upright weight 512 is provided at an outer end of each airfoil 51 between the pivot pins 511. The provision of weight 512 aims at shifting a center of gravity of the airfoil 51 to a position substantially between the pivot pins 511 for providing an increased stability to the pivoting airfoil 51. Moreover, a plurality of ropes 55 are provided each for interconnecting any two adjacent upper arms 52 or any two adjacent lower arms 52. Either end of the rope 55 is fastened at the free end of the arm 52 proximate the pivot pin 51. The provision of the ropes 55 aims at increasing a structural strength of the arms 52 so as to withstand a strong wind and enable the wind engine 50 to operate normally in high speed.

Figure 7:
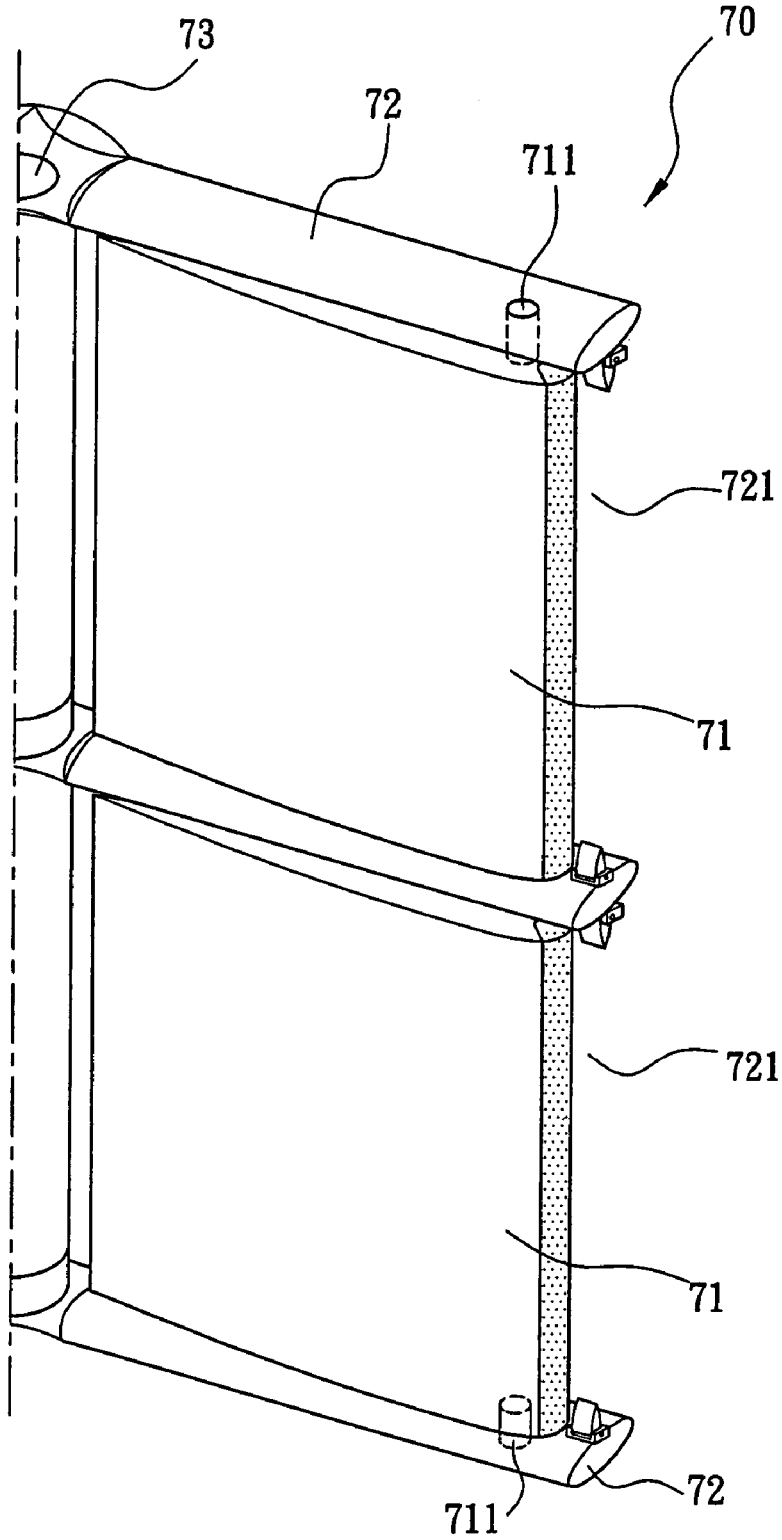
FIG. 7 is a partial perspective view of a second preferred embodiment of vertical axis wind engine according to the invention where arrangement of two upper and lower airfoils between two upper and lower arms is shown.

Referring to FIG. 7, a partial perspective view of a second preferred embodiment of vertical axis wind engine 70 according to the invention is shown. The wind engine 70 comprises a central, vertical axis 73 and a plurality of upper arms 72, a plurality of lower arms 72, and a sleeve put on the vertical axis 73 for connecting the upper arms 72 to the lower arms 72. Rotation of the arms 72 causes the vertical axis 73 to rotate the same. Also, each pair of arms 72 (i.e., an upper arm 72 and a corresponding lower arm 72) are adapted to define one of a plurality of airfoil receiving spaces 721 therein. A pair of upper and lower airfoils 71 of a plurality of airfoils 71 are pivotably mounted in the airfoil receiving space 721. That is, the airfoil 71 is adapted to pivot in the airfoil receiving space 721. A pair of elastic stop members (hidden by the airfoils 71) are provided on each pair of arms 72. The stop members are proximate top and bottom of each airfoil 71 respectively and are spaced from the pivot pins 711. The stop members are adapted to limit a pivot angle of the airfoil 71. Each of some airfoils 71 can exhibit a wide contour when a steady wind is blowing toward the vertical axis wind engine 70 (i.e., windward). As such, the most resistance to wind can be offered by these airfoils 71. To the contrary, each of some other airfoils 71 can exhibit a narrow contour when they are disposed at a leeward side of the wind. As such, the least resistance to wind can be offered by these airfoils 71. Some airfoils 71 may experience a pushing force of the wind larger than a maximum resistance force thereof in a strong wind condition (e.g., in hurricane). In response, the stop members pivot away from the arms 72 to lift the pivot limitation of each airfoil 71. As such, each airfoil 71 is adapted to pivot so as to have a contour to offer the least resistance to wind. As a result, the force of wind exerted on the wind engine 70 can be decreased greatly for preventing the arms 72, the airfoils 71, and other components of the wind engine 70 from being damaged by strong wind or when the wind engine 70 is operating in high speed.

Figure 8:
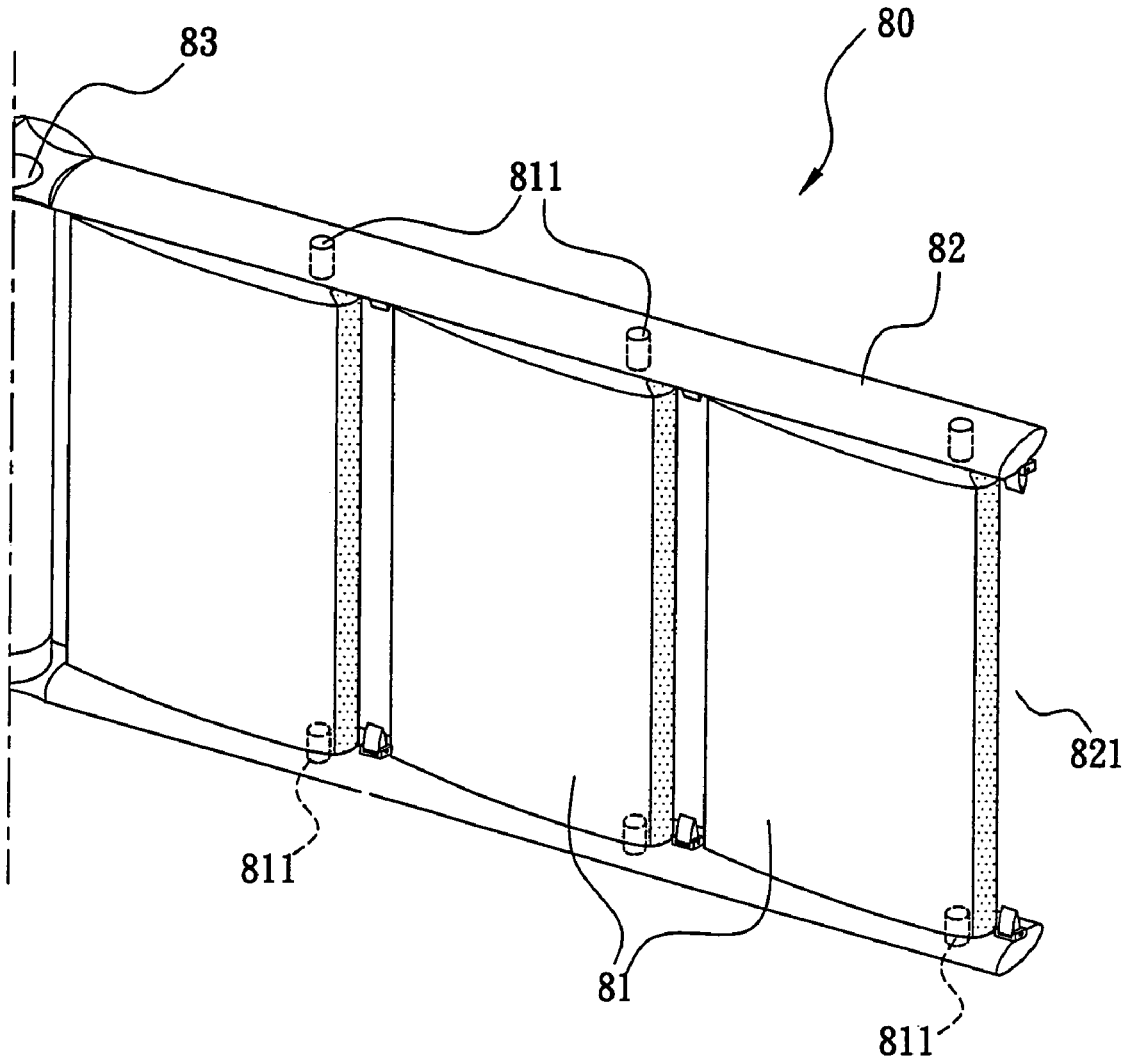
FIG. 8 is a partial perspective view of a third preferred embodiment of vertical axis wind engine according to the invention where three airfoils are arranged side by side between two upper and lower arms.

Referring to FIG. 8, a partial perspective view of a third preferred embodiment of vertical axis wind engine 80 according to the invention is shown. The wind engine 80 comprises a central, vertical axis 83 and a plurality of upper arms 82, a plurality of lower arms 82, and a sleeve put on the vertical axis 83 for connecting the upper arms 82 to the lower arms 82. Rotation of the arms 82 causes the vertical axis 83 to rotate the same. Also, each pair of arms 82 (i.e., an upper arm 82 and a corresponding lower arm 82) are adapted to define one of a plurality of airfoil receiving spaces 821 therein. Each of at least one airfoil (three airfoils side-by-side are shown) 81 is pivotably mounted in the airfoil receiving space 821. That is, the airfoil 81 is adapted to pivot in the airfoil receiving space 821. A pair of elastic stop members (hidden by the airfoils 81) are provided on each pair of arms 82. The stop members are proximate top and bottom of each airfoil 81 respectively and are spaced from the pivot pins 811. The stop members are adapted to limit a pivot angle of the airfoil 81. Each of some airfoils 81 can exhibit a wide contour when a steady wind is blowing toward the vertical axis wind engine 80 (i.e., windward). As such, the most resistance to wind can be offered by these airfoils 81. To the contrary, each of some other airfoils 81 can exhibit a narrow contour when they are disposed at a leeward side of the wind. As such, the least resistance to wind can be offered by these airfoils 81. Some airfoils 81 may experience a pushing force of the wind larger than a maximum resistance force thereof in a strong wind condition. In response, the stop members pivot away from the arms 82 to lift the pivot limitation of each airfoil 81. As such, each airfoil 81 is adapted to pivot so as to have a contour to offer the least resistance to wind. As a result, the force of wind exerted on the wind engine 80 can be decreased greatly for preventing components of the wind engine 80 from being damaged by strong wind or when the wind engine 80 is operating in high speed.

In view of the above embodiment, a plurality of airfoils 81 are mounted in the airfoil receiving space 821 such that size of each airfoil 81 can be greatly decreased and the force of wind exerted on each airfoil 81 can also be decreased. Moreover, smaller airfoils 81 are easier to manufacture and are convenient, simple, and quick in its storage, shipment, and assembly. A plurality of pairs of upper arm 82 and lower arm 82 are radially extended from the vertical axis 83. Each pair of arms 82 are adapted to define one of a plurality of airfoil receiving spaces 821 therein. Also, each set of a plurality of sets of a plurality of airfoils (three airfoils are shown) 81 are pivotably mounted in the airfoil receiving space 821. In view of the above discussion, a designer of vertical axis wind engine can flexibly customize the number of airfoils 81 disposed between each pair of arms 82 depending on applications in which the plurality of pairs of upper arm 82 and lower arm 82 are radially extended from the vertical axis 83.

Figure 9:
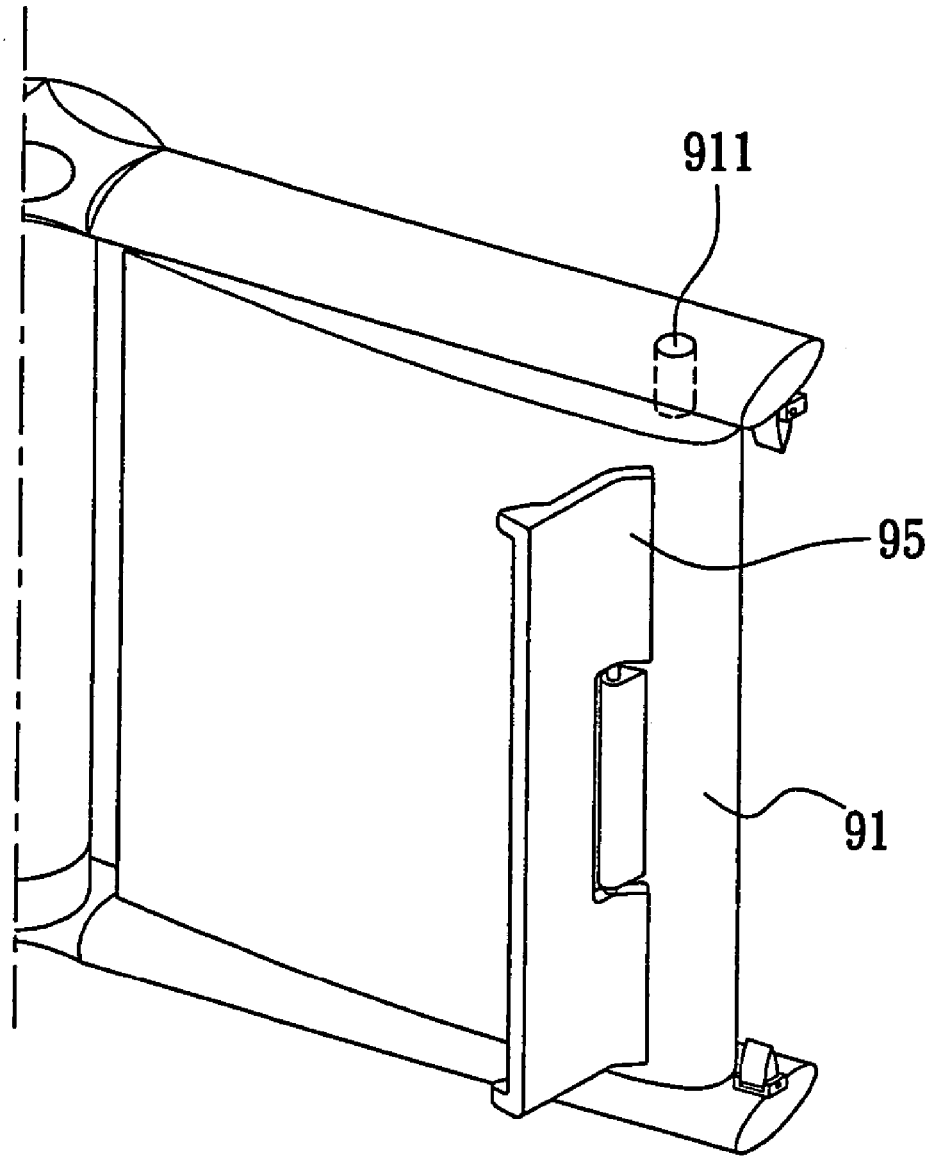
FIG. 9 is a perspective view of an auxiliary airfoil longitudinally, pivotably mounted on the airfoil according to the invention.

Note that each airfoil 81 in the above embodiment of the invention has a flat or curved surface designed according to the principles of air dynamics. Referring to FIG. 9, irrespective of the shape of the airfoil 91 at least one auxiliary airfoil 95 is longitudinally, pivotably mounted on a windward side of the airfoil 91 proximate an outer end thereof between the pivot pins 911. The provision of the auxiliary airfoil 95 aims at either exhibiting a wide contour of the airfoil 91 by pivoting outwardly for increasing an angle-of-attack in the windward side of the airfoil 91 (i.e., fully utilizing the force of breeze) or exhibiting a narrow contour of the airfoil 91 by pivoting inwardly toward a surface of the airfoil 91 for offering the least resistance to wind.

While the invention herein disclosed has been described by means of specific embodiments, numerous modifications and variations could be made thereto by those skilled in the art without departing from the scope and spirit of the invention set forth in the claims.

What is claimed is:

1. A vertical axis wind engine comprising:

a vertical axis mounted on a base;

a transmission provided in a lower portion of the vertical axis for rotational movement output from the vertical axis;

at least one arm, each arm having an end rotatably coupled to the vertical axis wherein at least one pair of upper and lower arms are adapted to define an airfoil receiving space therein;

at least one airfoil, each airfoil including two pivot pins provided at a top and a bottom thereof respectively, the pivot pins being located distal to the vertical axis, and each airfoil being adapted to be pivotably mounted within the respective airfoil receiving space by pivoting about the pivot pins;

at least one elastic stop member provided on each arm proximate to the airfoil and spaced from the pivot pin, each stop member being adapted to limit a pivot angle of the respective airfoil;

wherein each stop member is adapted to lift the pivot limitation of each respective airfoil for allowing the airfoil to pivot when the airfoil experiences a pushing force of the wind that is larger than a maximum resistance force thereof;

wherein each of some airfoils are adapted to exhibit a narrow contour for offering the least resistance to wind disposed at the leeward side of the respective airfoils;

wherein each of some airfoils are adapted to exhibit a wide contour for offering the most resistance to wind by pivoting the respective stop members to their limits when the respective airfoils are disposed at their leeward side; and two opposite pivotal pawl elements at each pair of the arms, each pawl element being located near a free end of respective arms distal to the vertical axis; wherein each pawl element is adapted to pivot toward a predetermined direction only in response to force exerted thereon and is adapted to return to its original position after the force is removed, such that the pawl elements are adapted to stop and prevent the airfoils from pivoting counterclockwise to their windward sides from their leeward sides and enable the airfoils to have a wide contour; and wherein each airfoil is adapted to pivot clockwise to contact and pass the pawl elements after the pivot limitations imposed on the airfoils by the respective stop members have been lifted by a strong wind so as to enable each airfoil to have a normal wide contour.

2. The vertical axis wind engine according to claim 1, wherein the stop member is provided on the arm proximate to the airfoil and has a length to enable it to contact a surface of the airfoil for limiting the pivot angle of the airfoil, and wherein the stop member is adapted to lift the pivot limitation of the airfoil by pivoting away from the airfoil for allowing the airfoil to pivot when the airfoil experiences a pushing force of the wind larger than a maximum resistance force thereof.

3. The vertical axis wind engine of claim 2, wherein each airfoil further comprises at least one auxiliary airfoil longitudinally, pivotably mounted on its windward side proximate an outer end thereof between the pivot pins, and wherein the auxiliary airfoil is adapted to either exhibit a wide contour of the airfoil in the windward side of the airfoil or exhibit a narrow contour of the airfoil by pivoting onto the airfoil in the leeward side thereof.

4. The vertical axis wind engine of claim 2, wherein a section of each arm as viewed from either a top or a bottom thereof toward the airfoil receiving space has a curved outer surface designed according to the principles of air dynamics.

5. The vertical axis wind engine of claim 2, further comprising an upright weight at an outer end of each airfoil between the pivot pins, and wherein the weight is adapted to shift a center of gravity of the airfoil to a position substantially between the pivot pins.

* * * * *